US009889678B2

(12) United States Patent
Hamada

(10) Patent No.: US 9,889,678 B2
(45) Date of Patent: Feb. 13, 2018

(54) MEDIUM SUPPORTING UNIT AND RECORDING APPARATUS

(71) Applicant: SEIKO EPSON CORPORATION, Tokyo (JP)

(72) Inventor: Nobuhiko Hamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/611,944

(22) Filed: Jun. 2, 2017

(65) Prior Publication Data

US 2017/0266984 A1 Sep. 21, 2017

Related U.S. Application Data

(63) Continuation of application No. 15/051,469, filed on Feb. 23, 2016, now Pat. No. 9,694,600.

(30) Foreign Application Priority Data

Feb. 25, 2015 (JP) ..... 2015-035015

(51) Int. Cl.
*B41J 3/407* (2006.01)
*B41J 11/06* (2006.01)

(52) U.S. Cl.
CPC ..... *B41J 3/4078* (2013.01); *B41J 11/06* (2013.01)

(58) Field of Classification Search
CPC . B41J 3/4078; B41J 29/02; B41J 29/06; B41J 13/10
See application file for complete search history.

(56) References Cited

U.S. PATENT DOCUMENTS

2003/0197772 A1* 10/2003 Iwatsuki ..... B41J 3/4078 347/104
2004/0179081 A1* 9/2004 Nimi ..... B41J 2/01 347/104
2004/0189776 A1 9/2004 Niimi et al.
2013/0278697 A1 10/2013 Takeuchi et al.
2013/0278698 A1 10/2013 Takeuchi et al.
(Continued)

FOREIGN PATENT DOCUMENTS

JP 3969168 9/2007
JP 4055622 3/2008
JP 2013226657 11/2013

OTHER PUBLICATIONS

Office Action issued in U.S. Appl. No. 15/051,469 dated Jul. 29, 2016.

(Continued)

*Primary Examiner* — Geoffrey Mruk
*Assistant Examiner* — Scott A Richmond
(74) *Attorney, Agent, or Firm* — Workman Nydegger

(57) ABSTRACT

A medium supporting unit includes a supporting unit including a supporting face which supports a medium, and a receiving unit in which a receiving face which is recessed with respect to the supporting face is formed; and a pressing unit which can press the medium which is supported by the supporting unit by being received on the receiving face, in which the receiving unit is formed of a material of which rigidity is higher than a material which forms the supporting face. By configuring such a medium supporting unit, it is possible to make the supporting unit thin and light weight.

8 Claims, 7 Drawing Sheets

(56) References Cited

U.S. PATENT DOCUMENTS

| | | | | |
|---|---|---|---|---|
| 2015/0151551 | A1* | 6/2015 | Livingston | B41J 3/4078 347/110 |
| 2016/0243852 | A1 | 8/2016 | Hamada | |

OTHER PUBLICATIONS

Office Action issued in U.S. Appl. No. 15/051,469 dated Nov. 25, 2016.
Notice of Allowance issuded in U.S. Appl. No. 15/051,469 dated Mar. 15, 2017.
"Mark's Standard Handbook for Mechanical Engineers" Tenth Edition, McGraw-Hill, 1916, Section 3.2, Tables 3.2.2-3.2.6.

* cited by examiner

MEDIUM SUPPORTING UNIT AND RECORDING APPARATUS

CROSS REFERENCES TO RELATED APPLICATIONS

This application is a continuation of U.S. application Ser. No. 15/051,469, filed Feb. 23, 2016, which claims priority to Japanese Application No. 2015-035015, filed Feb. 25, 2015, the entireties of which are incorporated by reference herein.

BACKGROUND

1. Technical Field

The present invention relates to a medium supporting unit, and a recording apparatus.

2. Related Art

In the related art, a medium supporting unit which includes a pressing unit which can press a medium supported by a supporting unit has been used. It is possible to set a medium by suppressing floating of the medium by pressing the medium using the pressing unit.

For example, in JP-A-2013-226657, a medium supporting unit which includes a setting tray as a supporting unit, and a frame as a pressing unit which can press the medium supported by the setting tray is disclosed. Here, an edge portion as a receiving unit for receiving the frame is formed over the entire periphery of the edge portion in the setting tray of the medium supporting unit.

In the medium supporting unit which includes the pressing unit which can press the medium supported by the supporting unit, it is desirable to make the supporting unit thin and light weight.

However, when the supporting unit is thin and light weight, the supporting unit is easily damaged. In general, in a medium supporting unit in the related art, a receiving unit for receiving the pressing unit is provided at an edge portion of the pressing unit, and is integrally formed with the pressing unit. Due to such a configuration, when the supporting unit is set to be thin, the receiving unit also becomes thin, and is thinly provided at the edge portion, and as a result, particularly, the receiving unit is easily damaged. For this reason, it has been difficult to make the supporting unit thin and light weight.

In addition, in JP-A-2013-226657, it is described that a reinforcing frame may be provided at the periphery of a main body of the supporting unit; however, there is no specific description about a configuration of the receiving unit.

SUMMARY

An advantage of some aspects of the invention is to make a supporting unit thin and light weight in a medium supporting unit which includes a pressing unit which can press a medium supported by the supporting unit.

According to an aspect of the invention, there is provided a medium supporting unit which includes a supporting unit including a supporting face which supports a medium, and a receiving unit in which a receiving face which is recessed with respect to the supporting face is formed, and a pressing unit which can press the medium which is supported by the supporting unit by being received on the receiving face, in which the receiving unit is formed of a material of which rigidity is higher than a material which forms the supporting face.

In the medium supporting unit, the supporting unit may have a side face portion which is located between the supporting face and the receiving face, and forms a side face which connects the supporting face and the receiving face, and the side face portion may have a first side face which is formed of a material forming the receiving unit.

In the medium supporting unit, the side face portion may have a second side face which is formed of a material forming the supporting face.

In the medium supporting unit, the receiving unit may be formed of the receiving face and the first side face which are continuous.

In the medium supporting unit, the receiving face may be formed of a material of which a coefficient of static friction is larger than that of the supporting face.

In the medium supporting unit, unevenness may be formed on the receiving face.

According to another aspect of the invention, there is provided a recording apparatus which includes the medium supporting unit according to the aspect, and a recording unit which can perform recording on the medium which is supported by the medium supporting unit.

According to the invention, it is possible to make a supporting unit thin and light weight in a medium supporting unit which includes a pressing unit which can press a medium supported by the supporting unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a medium supporting unit 2 according to an embodiment of the invention, and a recording apparatus 1 according to an embodiment which includes the medium supporting unit 2 will be described in detail with reference to accompanying drawings.

First Embodiment (FIGS. 1 to 6)

First, an outline of the recording apparatus 1 according to a first embodiment will be described.

Figure 1:
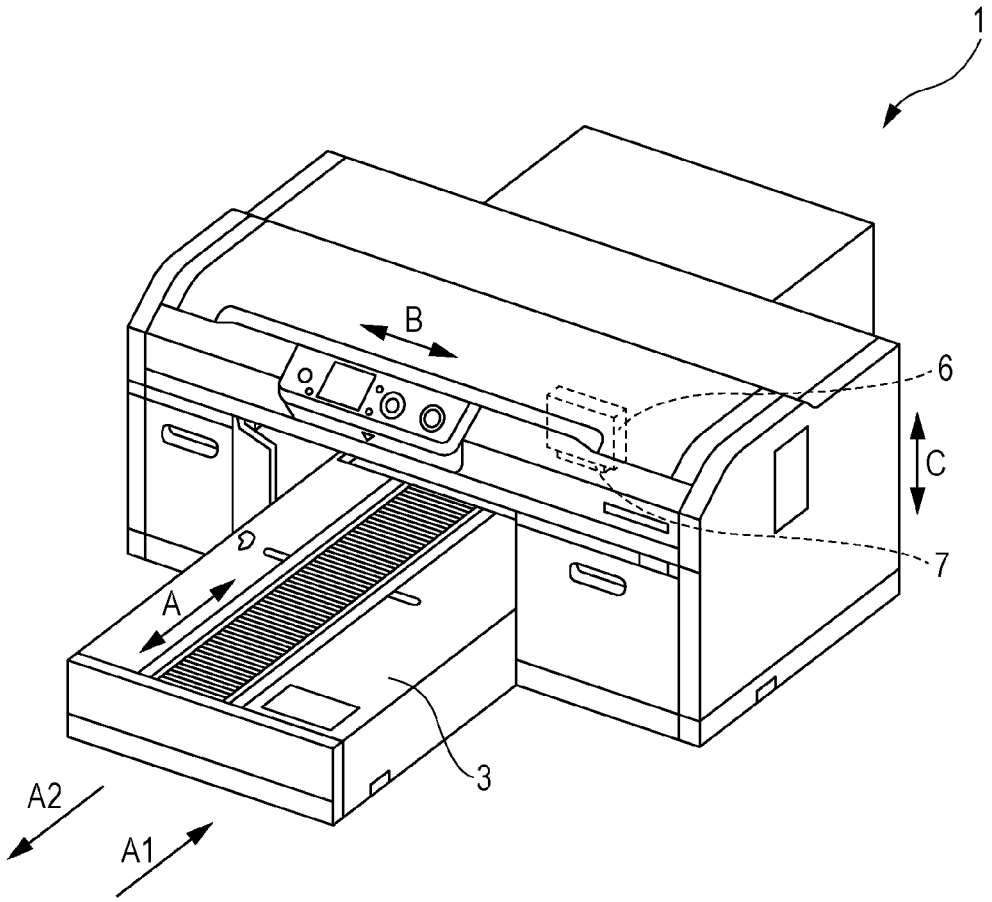
FIG. 1 is a perspective view which schematically illustrates a recording apparatus according to a first embodiment of the invention.
Figure 2:
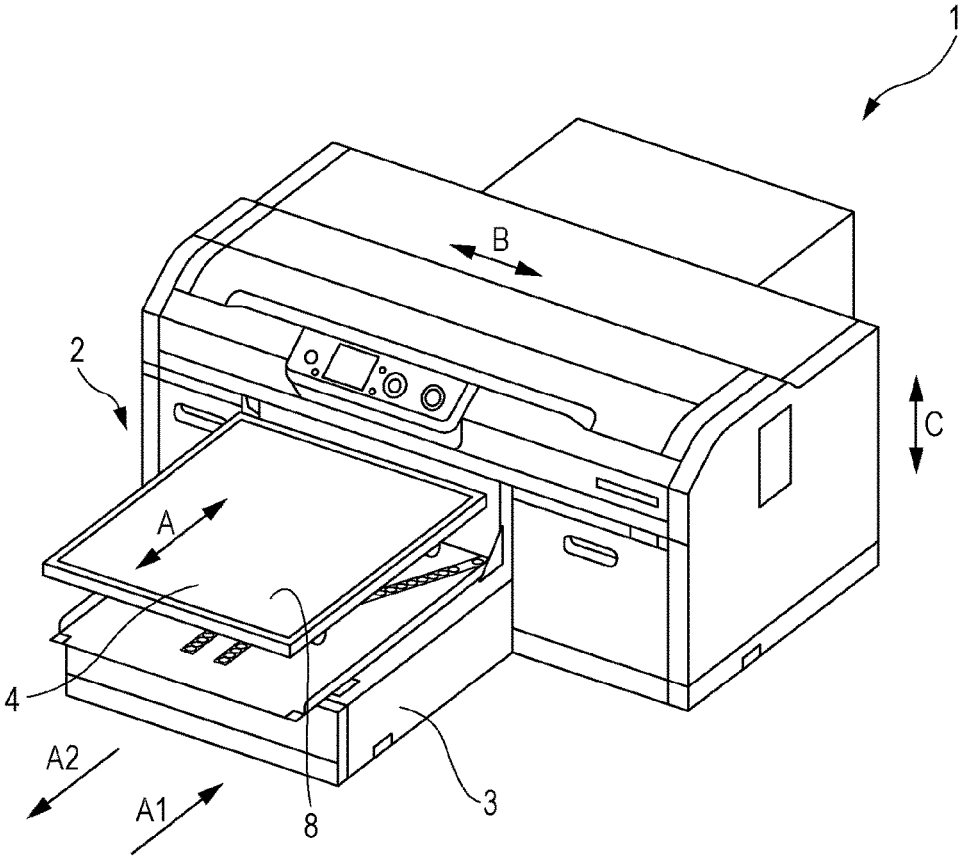
FIG. 2 is a perspective view which schematically illustrates the recording apparatus according to the first embodiment of the invention.

FIGS. 1 and 2 are perspective views which schematically illustrate the recording apparatus 1 according to the first embodiment of the invention, and in the figures, FIG. 1 illustrates a state in which a tray 4 as a supporting unit of a medium M (refer to FIG. 4) of the recording apparatus 1 according to the embodiment is located at a recording start position, and FIG. 2 illustrates a state in which the tray 4 is located at a setting position of the medium M.

Figure 3:
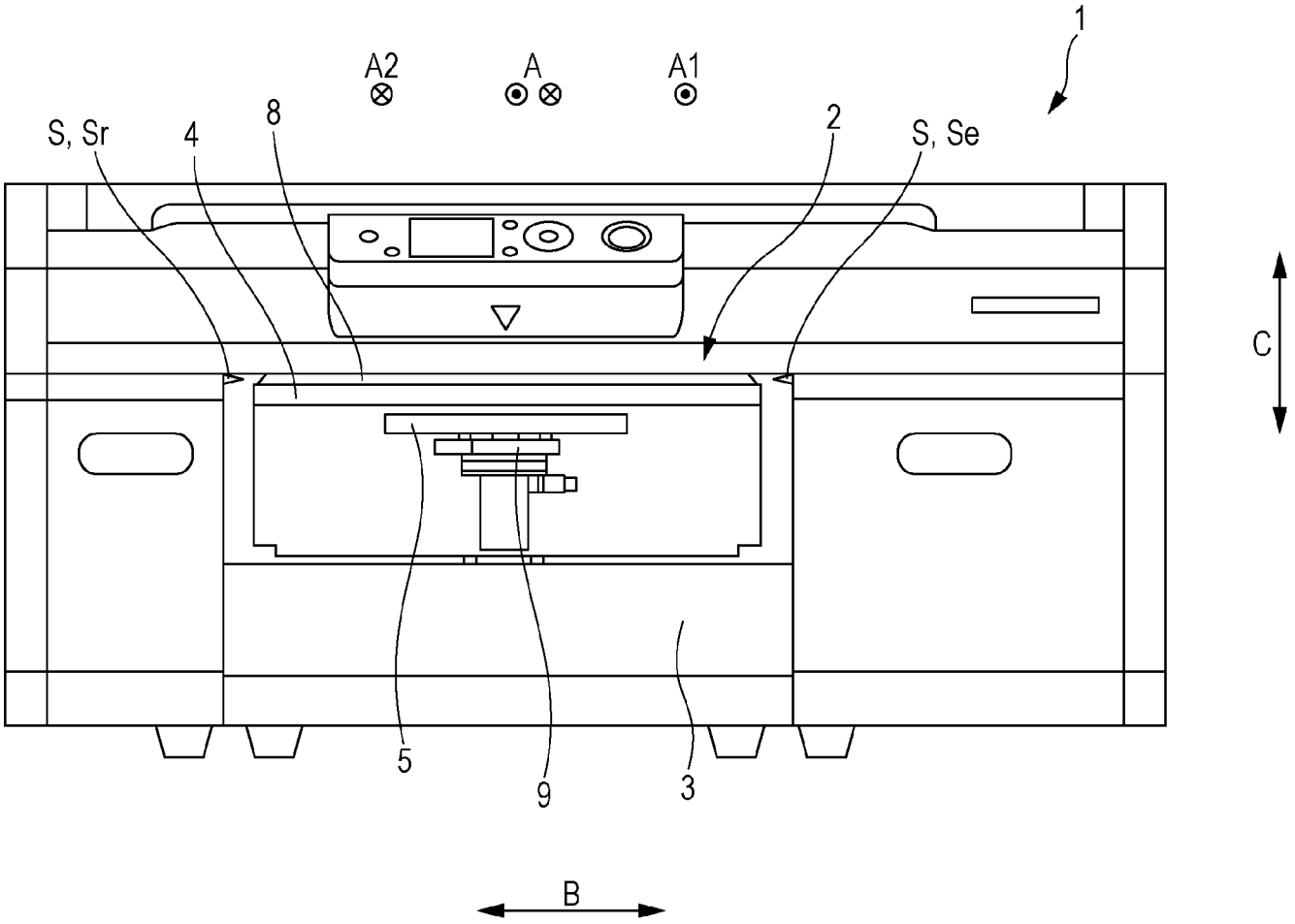
FIG. 3 is a front view which schematically illustrates the recording apparatus according to the first embodiment of the invention.

In addition, FIG. 3 is a front view which schematically illustrates the recording apparatus 1 according to the embodiment.

The recording apparatus 1 according to the embodiment includes the medium supporting unit 2 which moves in a movement direction A in a state in which the medium M is supported on a supporting face 8 of the tray 4. The medium supporting unit 2 includes the tray 4 which is a supporting unit of the medium M. The recording apparatus 1 includes a medium transport unit 3 which transports the medium M supported by the tray 4 in the movement direction A. The movement direction A is a direction which includes a direction A1, and a direction A2 which is opposite to the direction A1. In addition, the tray 4 is mounted on a stage 5. The tray 4 moves together with the stage 5 in a height direction C when a rotary lever 9 is rotated. As the medium M, it is possible to use various materials such as textile (woven stuff, cloth, or the like), paper, a polyvinyl chloride resin.

In addition, a recording head 7 which can perform recording on the medium M by ejecting ink is included in the inside of a main body of the recording apparatus 1. In the embodiment, the recording head 7 corresponds to a recording unit which can perform recoding on the medium M. In addition, the recording apparatus 1 according to the embodiment forms a desired image by ejecting ink onto the medium M which is supported by the tray 4 from the recording head 7 while causing the recording head 7 to reciprocate in an intersecting direction B, by causing the carriage 6 in which the recording head 7 is provided to reciprocate in the intersecting direction B which intersects the movement direction A.

In the recording apparatus 1 according to the embodiment, a near side (lower left direction) in FIGS. 1 and 2 is a setting position (corresponding to FIG. 2) of the medium M with respect to the tray 4. In addition, recording is performed while moving the tray 4 in the direction A2 in the movement direction A, after moving the tray 4 in which the medium M is set in the direction A1 in the movement direction A to a recording start position (corresponding to FIG. 1) on a depth side (higher right direction) in FIGS. 1 and 2.

The recording apparatus 1 according to the embodiment includes the recording head 7 which performs recording while reciprocating in the intersecting direction B; however, the recording apparatus may be a recording apparatus which includes a so-called line head in which a plurality of nozzles which eject ink are provided in the intersecting direction B which intersects the movement direction A.

Here, the "line head" is a recording head which is used in a recording apparatus in which a region of nozzles which are formed in the intersecting direction B which intersects the movement direction A of the medium M is provided so as to cover the entire intersecting direction B of the medium M, and which forms an image by relatively moving a recording head or a medium M. In addition, the region of the nozzle the intersecting direction B of the line head may not cover the entire intersecting direction B of all of the mediums M to which the recording apparatus 1 corresponds.

In addition, the recording head 7 according to the embodiment is a recording unit which can perform recording by ejecting ink on the medium M; however, it is not limited to such a recording unit, and for example, a transfer-type recording unit which performs recording by transferring a coloring material onto the medium M may be used.

The recording apparatus 1 according to the embodiment includes a sensor S as illustrated in FIG. 3, and it is possible for the sensor to detect whether or not an interval between the medium M supported by the tray 4 and the recording head 7 is abnormal (interval between medium M and recording head 7 is excessively small).

Here, the sensor S includes a light emitting unit Se and a light receiving unit Sr. In addition, the sensor S has a configuration in which whether or not the interval is abnormal is detected by determining whether or not light is received in the light receiving unit Sr, by radiating the light from the light emitting unit Se to the light receiving unit Sr. However, the configuration is not limited to this.

Subsequently, the medium supporting unit 2 according to the first embodiment of the invention will be described in detail.

Figure 4:
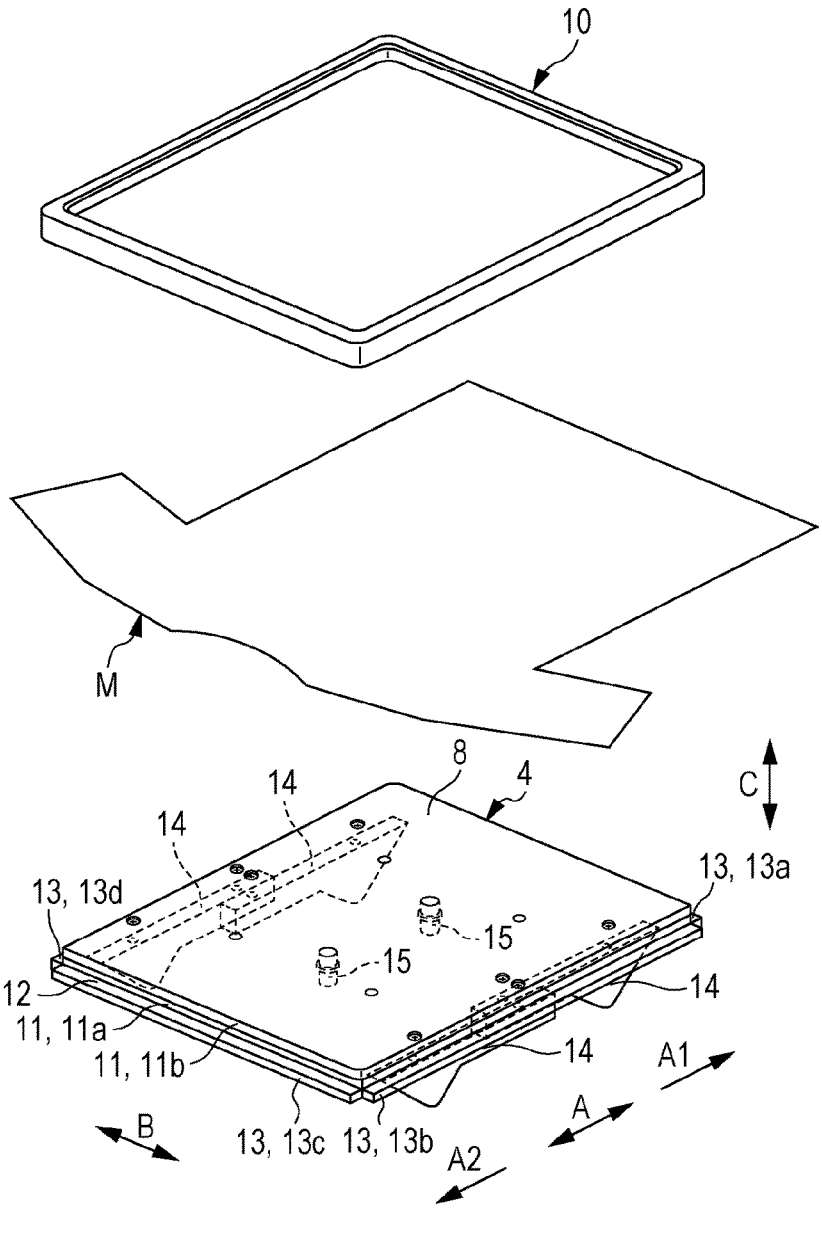
FIG. 4 is a perspective view which schematically illustrates a medium supporting unit according to the first embodiment of the invention.
Figure 5:
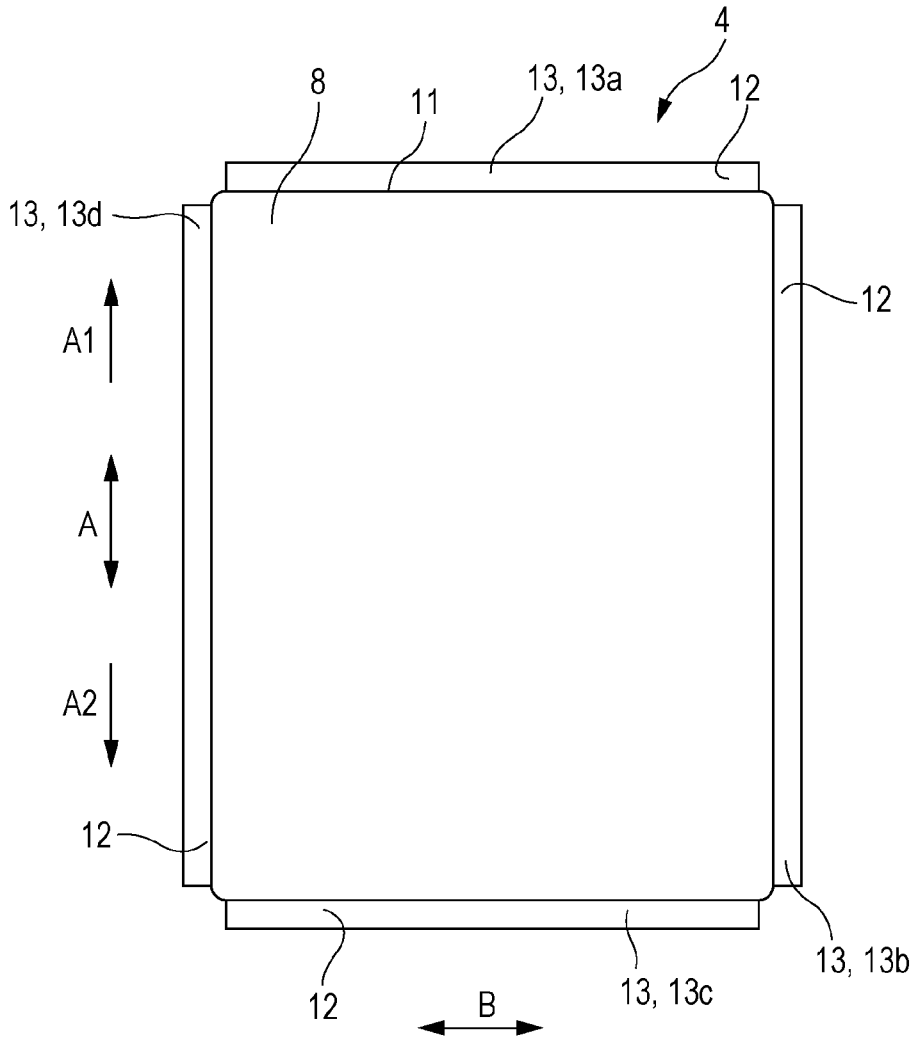
FIG. 5 is a plan view which schematically illustrates the medium supporting unit according to the first embodiment of the invention.
Figure 6:
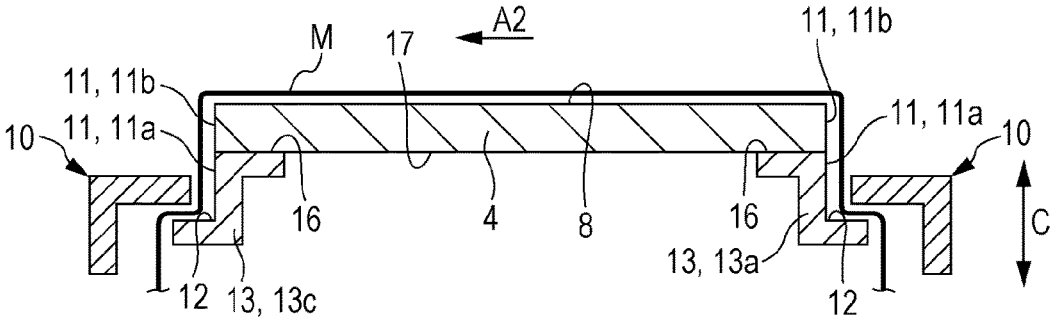
FIG. 6 is a side-sectional view which schematically illustrates the medium supporting unit according to the first embodiment of the invention.

Here, FIG. 4 is a perspective view which schematically illustrates the medium supporting unit 2 according to the embodiment. In addition, FIG. 5 is a plan view which schematically illustrates the medium supporting unit 2 according to the embodiment. FIGS. 6 to 7B are side-sectional views which schematically illustrate the medium supporting unit 2 according to the embodiment.

As illustrated in FIG. 4, the medium supporting unit 2 according to the embodiment includes the tray 4 as the supporting unit, and a pressing unit 10 which can press the medium M supported by the tray 4.

Here, the tray 4 includes a supporting face 8 which supports the medium M, and a receiving unit 13 in which a receiving face 12 which is recessed with respect to the supporting face 8 is formed. In addition, as illustrated in FIG. 6, the pressing unit 10 has a configuration in which it is possible to suppress the medium M which is supported by the tray 4 by being received on the receiving face 12.

In addition, the receiving unit 13 is formed of a material of which rigidity is higher than that of a material which forms the supporting face 8. In this manner, since the receiving unit 13 is configured as a separate member from a forming member of the supporting face 8 in the medium supporting unit 2 according to the embodiment, it is possible to easily configure the tray 4 which has characteristics which are needed in each of the receiving unit 13 and the supporting face 8, compared to the tray 4 in which the receiving unit 13 is integrally configured with the supporting face 8. Here, when the receiving unit 13 is configured integrally with the supporting face 8, in order to make the receiving unit 13 which is easily damaged, in general, hard to be damaged, it is necessary to configure the receiving unit 13 and the supporting face 8 using a high rigidity material, or to configure the receiving unit 13 and the supporting face 8 so as to be thick. However, in many cases, a high rigidity material is heavy, and when the supporting face 8 is configured using the high rigidity material, there is a tendency that the tray 4 becomes heavy. In addition, when the receiving unit 13 and the supporting face 8 are configured so as to be thick, as a matter of course, there is a tendency that the tray 4 becomes heavy. Meanwhile, in the medium supporting unit 2 according to the embodiment, it is possible to make the tray 4 thin and light weight, since the receiving unit 13 which is easily damaged in general, is configured as a unit which is hard to be damaged using a high rigidity material, as a separate member from the forming member of the supporting face 8.

That is, in other words, the recording apparatus 1 according to the embodiment is configured so as to perform recording by supporting the medium M using the tray 4 configured as a tray which is thin and light weight.

As illustrated in FIGS. 4 and 5, the receiving unit 13 is configured of four receiving units of 13*a*, 13*b*, 13*c*, and 13*d* which are made of metal, respectively. For this reason, it is possible to simply configure each of the receiving units 13. However, the receiving unit 13 is not limited to such a configuration, and may be configured as one constituent element.

In addition, as illustrated in FIG. 5, the receiving units 13*a*, 13*b*, 13*c*, and 13*d* corresponding to each side of the tray 4 have a configuration of having a gap therebetween, respectively, when planarly viewed (when viewed in direction orthogonal to supporting face 8). Specifically, when planarly viewed, there are gaps between the receiving units 13*a* and 13*b*, between the receiving units 13*b* and 13*c*, between the receiving units 13*c* and 13*d*, and between receiving units 13*d* and 13*a*. In other words, the receiving unit 13 is not formed at portions corresponding to four corners of the supporting face 8 which is approximately rectangular. By adopting such a configuration, it is possible to make the tray 4 light weight by reducing a volume thereof.

A portion other than the receiving unit 13 in the tray 4 such as the supporting face 8, or the like, is configured of an acrylic resin. Here, a material of the receiving unit 13, and a material of the portion other than the receiving unit 13 in the tray 4 such as the supporting face 8 are not limited. However, it is preferable that the receiving unit 13 is made of metal, and the supporting face 8 is made of a hard polymeric substance when considering strength, weight, a cost, or the like.

As illustrated in FIGS. 4 and 6, the tray 4 according to the embodiment includes a side face portion 11 which is located between the supporting face 8 and the receiving face 12, and forms a side face which connects the supporting face 8 and the receiving face 12. The side face portion 11 includes a first side face 11*a* which is formed of a material forming the receiving unit 13.

For this reason, since it is also possible to make the side face portion 11 hard to be damaged, the tray 4 can be set to be thin and light weight, particularly.

Here, in the receiving unit 13, the receiving face 12 and the first side face 11*a* are continuously formed. For this reason, it is possible to simply form a configuration in which the side face portion 11 is hard to be damaged. That is, the tray 4 is set to be thin and light weight, simply, and particularly.

The first side face 11*a* according to the embodiment is configured integrally with the receiving unit 13; however, the first side face may be formed as a separate member from the receiving unit 13.

As illustrated in FIGS. 4 and 6, the side face portion 11 in the tray 4 according to the embodiment includes a second side face 11*b* which is formed of a material forming the supporting face 8. In detail, in the tray 4 according to the embodiment, a top face 16 of the receiving unit 13 is attached to a face 17 on a side opposite to the supporting face 8 at an end portion of the forming member of the plate-shaped supporting face 8. In addition, a side face of the supporting face 8 in the forming member of the plate-shaped supporting face 8 forms the second side face 11*b*. By adopting such a configuration, it is possible to make a configuration of the tray 4 simple.

In addition, as illustrated in FIG. 6, the side face portion 11 is configured so as to remarkably protrude toward a higher side with respect to the pressing unit 10. By adopting such a configuration, the pressing unit 10 is hardly detached from the tray 4 even when the pressing unit 10 is inclined due to an external force, or the like. Specifically, 50% or more of the side face portion 11 in the height direction protrudes toward the higher side compared to the pressing unit 10. At this time, a part of the first side face 11*a* in the side face portion 11 is located below the pressing unit 10, and a part other than that protrudes upward compared to the pressing unit 10. In addition, the entire second side face 11*b* in the side face portion 11 protrudes upward compared to the pressing unit 10. By adopting such a configuration, a border portion between the first side face 11*a* and the second side face 11*b* does not face the pressing unit 10, and it is possible to suppress a load which is applied to the border portion between the first side face 11*a* and the second side face 11*b*.

In addition, unevenness using blast processing is formed on the receiving face 12 in the receiving unit 13 according to the embodiment. By adopting such a configuration, it is possible to make the tray 4 thin and light weight, and to suppress floating of the medium M when the medium M is supported by the supporting face 8, and is pressed by the pressing unit 10 since the receiving face 12 has a coefficient of static friction which is larger than that of the supporting face 8.

A forming method of the "unevenness" is not particularly limited.

In addition, the receiving face 12 in the receiving unit 13 may be formed of a material of which a coefficient of static friction is larger than that of the supporting face 8. By adopting such a configuration as well, it is possible to not only make the tray 4 thin and light weight, but also to suppress floating of the medium M when the medium M is supported by the supporting face 8, and is pressed by the pressing unit 10.

Figure 7A:
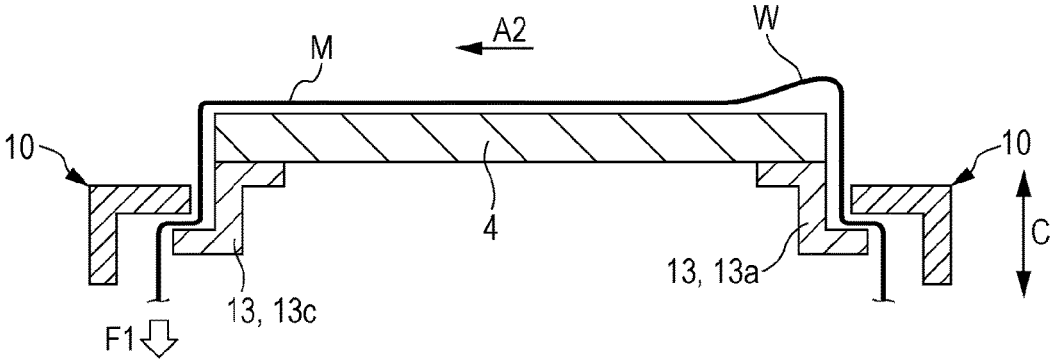
FIGS. 7A and 7B are side-sectional views which schematically illustrate the medium supporting unit according to the first embodiment of the invention.
Figure 7B:
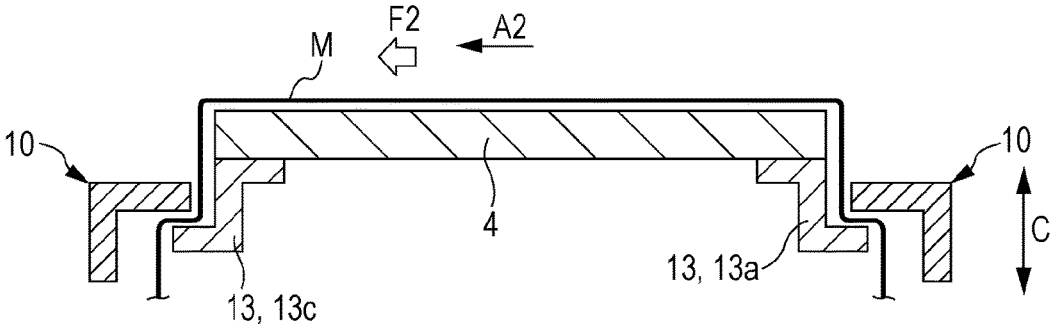

Here, FIG. 7A illustrates a state in which, in the medium supporting unit 2 according to the embodiment, the pressing unit 10 is combined with the tray 4 on which medium M is mounted from a state illustrated in FIG. 4 (state in which medium M is going to be set in tray 4), and a state in which a floatation W occurs on the upstream side in the direction A2 at this time.

In addition, FIG. 7B illustrates a state in which a worker pulls the medium M toward a direction F1 at a position on the downstream side in the direction A2 (position on near side (lower left direction) in FIGS. 1 and 2) from the state illustrated in FIG. 7A, and the floatation W is eliminated.

In this manner, in the medium supporting unit 2 according to the embodiment, the floatation W is eliminated when the medium M on the supporting face 8 moves in a direction F2, along with pulling of the medium M in the direction F1. The reason for this is that, by setting the coefficient of static friction on the receiving face 12 to be large, the medium M on the supporting face 8 moves in the direction F2 while being firmly pressed on the upstream side in the direction A2 by being pulled in a state of being firmly pressed by the pressing unit 10 at a position of the receiving face 12 on the upstream side in the direction A2.

In addition, as illustrated in FIG. 4, the tray 4 according to the embodiment includes an installation unit 14 which is used when the tray is installed on a floor, or the like, by being detached from the stage 5, and a positioning unit 15 with which it is possible for the tray to be positioned with respect to the stage 5. However, the configuration of the tray 4 is not particularly limited.

Figure 8:
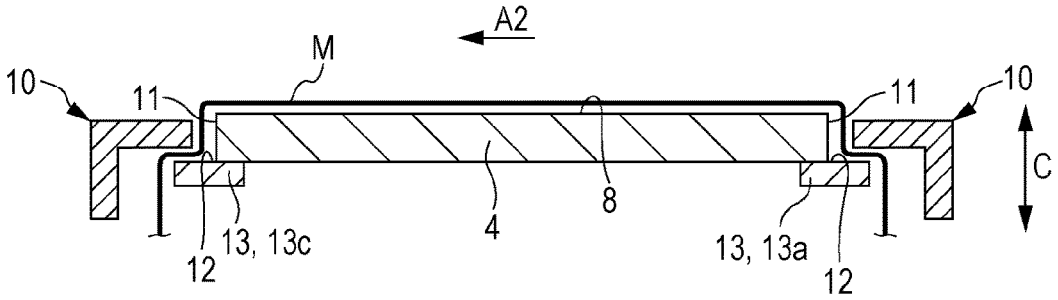
FIG. 8 is a side-sectional view which schematically illustrates a medium supporting unit according to a second embodiment of the invention.

Second Embodiment (FIG. 8)

Subsequently, a medium supporting unit according to a second embodiment of the invention will be described.

FIG. 8 is a side-sectional view which schematically illustrates a medium supporting unit 2 according to the second embodiment of the invention, and is a diagram corresponding to FIG. 6 in the first embodiment. In addition, constituent elements which are common to those in the first embodiment are given the same reference numerals, and detailed descriptions thereof will be omitted.

In the medium supporting unit 2 according to the embodiment, only a configuration of the receiving unit 13 is different from the medium supporting unit 2 in the first embodiment.

In the medium supporting unit 2 according to the first embodiment, the receiving unit 13 configures the first side face 11*a* in the side face portion 11.

Meanwhile, in the medium supporting unit 2 according to the embodiment, only a side face of an end portion of the forming member of the plate-shaped supporting face 8 configures the side face portion 11.

In addition, the medium supporting unit 2 according to the embodiment can be used in the recording apparatus 1 according to the first embodiment.

Figure 9:
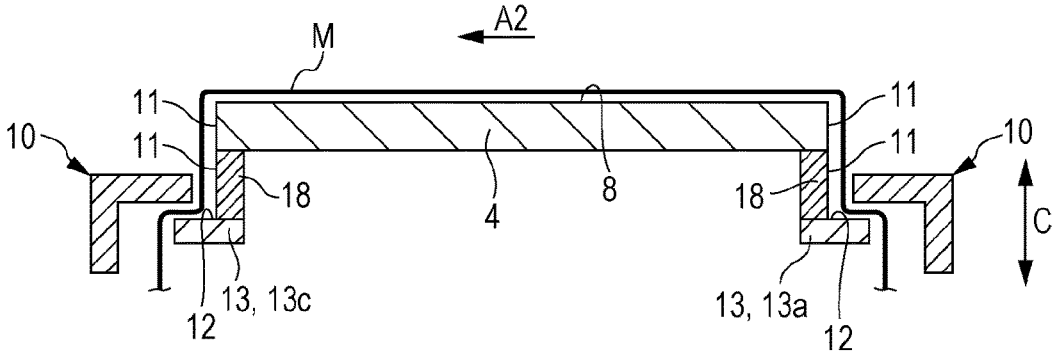
FIG. 9 is a side-sectional view which schematically illustrates a medium supporting unit according to a third embodiment of the invention.

Third Embodiment (FIG. 9)

Subsequently, a medium supporting unit according to a third embodiment of the invention will be described.

FIG. 9 is a side-sectional view which schematically illustrates a medium supporting unit 2 according to the third embodiment of the invention, and is a diagram corresponding to FIG. 6 in the first embodiment, and FIG. 8 in the second embodiment. In addition, constituent elements which are common to those in the first and second embodiments are given the same reference numerals, and detailed descriptions thereof will be omitted.

In the medium supporting unit 2 according to the embodiment, only a configuration in which a side face portion constituent member 18 which configures the side face portion 11 is included, in addition to the receiving unit 13, is different from the medium supporting unit 2 in the first and second embodiments.

In the medium supporting unit 2 according to the first embodiment, the receiving unit 13 configures the first side face 11*a* in the side face portion 11. In addition, in the medium supporting unit 2 according to the second embodiment, only the side face of an end portion of the plate-shaped forming member of the supporting face 8 configures the side face portion 11.

Meanwhile, the medium supporting unit 2 according to the embodiment includes a receiving unit 13 with a configuration which is the same as that of the receiving unit 13 according to the second embodiment, and includes the side face portion constituent member 18 which configures the side face portion 11 between the receiving unit 13 and the forming member of the plate-shaped supporting face 8. Here, the side face portion constituent member 18 according to the embodiment is configured using the same material as that of the receiving unit 13; however, the constituent member is not particularly limited, may be configured using the same material as that of the forming member of the plate-shaped supporting face 8, and may be configured using a material which is completely different from materials of both the receiving unit and the forming member of the plate-shaped supporting face.

In addition, the medium supporting unit 2 according to the embodiment can be used in the recording apparatus 1 according to the first embodiment.

The invention is not limited to the above described embodiments, can be variously modified in the scope of the invention which is described in claims, and it is needless to say that those modification examples are also included in the scope of the invention.

Hitherto, the invention has been described based on specific embodiments. Here, the invention will be collectively described again.

The medium supporting unit 2 according to an aspect of the invention includes the supporting unit 4 including the supporting face 8 which supports the medium M, and the receiving unit 13 in which the receiving face 12 which is recessed with respect to the supporting face 8 is formed, and the pressing unit 10 which can press the medium supported by the supporting unit 4 by being received on the receiving face 12, in which the receiving unit 13 is formed of a material of which rigidity is higher than that of the material which forms the supporting face 8.

According to the aspect, the receiving unit 13 is formed of a material of which rigidity is higher than that of the material which forms the supporting face 8. For this reason, by configuring the receiving unit 13 using a member separate from the forming member of the supporting face 8, it is possible to easily configure a tray 4 having characteristics which are needed in each of the receiving unit 13 and the supporting face 8, compared to the tray 4 in which the receiving unit 13 is configured integrally with the supporting face 8. In addition, it is possible to make the tray 4 thin and light weight by making the receiving unit 13 which is easily damaged, in general, hard to be damaged using a high rigidity material as a separate member from the forming member of the supporting face 8.

In the medium supporting unit 2 according to the aspect of the invention, the supporting unit 4 includes the side face portion 11 which is located between the supporting face 8 and the receiving face 12, and forms the side face which connects the supporting face 8 and the receiving face 12, and the side face portion 11 includes the first side face 11*a* which is formed using the material which forms the receiving unit 13.

According to the aspect, the side face portion 11 includes the first side face 11*a* which is formed using the material which forms the receiving unit 13. For this reason, it is possible to make the tray 4 thin and light weight particularly, since the side face portion 11 can also be configured as a portion which is hard to be damaged.

In the medium supporting unit 2 according to the aspect of the invention, the side face portion 11 includes the second side face 11*b* which is formed using the material which forms the supporting face 8.

According to the aspect, the side face portion 11 includes the second side face 11*b* which is formed using the material which forms the supporting face 8. For this reason, it is possible to make the configuration of the supporting unit 4 simple, for example, by attaching the receiving unit to the face 17 on the side opposite to the supporting face 8 at an end portion of the forming member of the plate-shaped supporting face 8.

In the medium supporting unit 2 according to the aspect of the invention, the receiving unit 13 is formed of the receiving face 12 and the first side face 11*a* which are continuous.

According to the aspect, the receiving unit 13 is formed of the receiving face 12 and the first side face 11*a* which are continuous. For this reason, particularly, it is possible to simply make the supporting unit 4 thin and light weight, since it is possible to simply make a configuration in which the side face portion 11 is not easily damaged.

In the medium supporting unit 2 according to the aspect of the invention, the receiving face 12 is formed of a material of which a coefficient of static friction is larger than that of the supporting face 8.

According to the aspect, the receiving face 12 is formed of a material of which a coefficient of static friction is larger than that of the supporting face 8. By adopting such a configuration, it is possible not only to make the supporting unit 4 thin and light weight, but also to suppress floating of the medium M when the medium M is supported by the supporting face 8, and is pressed by the pressing unit.

In the medium supporting unit 2 according to the aspect of the invention, the receiving face 12 is formed with unevenness.

According to the aspect, the receiving face 12 is formed with unevenness. By adopting such a configuration, it is possible not only to make the supporting unit 4 thin and light weight, but also to suppress floating of the medium M when the medium M is supported by the supporting face 8, and is pressed by the pressing unit 10.

In addition, a forming method of the "unevenness" is not particularly limited; however, for example, it is possible to form the unevenness in the contact faces 11*a* and 11*b* with the medium M in the pressing unit 10 by performing blast processing, or the like.

The recording apparatus 1 according to another aspect of the invention includes the medium supporting unit 2 according to the aspect, and the recording unit 7 which can perform recording on the medium M which is supported by medium supporting unit 2.

According to the aspect, it is possible to perform recording by supporting the medium M using the supporting unit 4 which is thin and light weight.

The entire disclosure of Japanese Patent Application No. 2015-035015, filed Feb. 25, 2015 is expressly incorporated reference herein.

What is claimed is:

1. A medium supporting unit comprising:

a supporting unit including a supporting face which supports a medium, and a receiving unit in which a receiving face is formed; and a pressing unit which can press the medium which is supported by the supporting unit, by being received on the receiving face, wherein the supporting face includes a first side, and a second side along a direction intersecting with the first side, the receiving unit includes a first receiving unit attached to the first side, and a second receiving unit attached to the second side, and the supporting unit defines a first gap between the first receiving unit and the second receiving unit, when viewed in a first direction orthogonal to the supporting face.

2. The medium supporting unit according to claim 1, wherein the supporting face includes a third side along a direction intersecting with the first side, the supporting face includes a third receiving unit attached to the third side, and the supporting unit defines a second gap between the first receiving unit and the third receiving unit, when viewed in the first direction.

3. The medium supporting unit according to claim 2, wherein the supporting face includes a fourth side along a direction intersecting with the second side and the third side, the supporting face includes a fourth receiving unit attached to the fourth side, and the supporting unit defines a third gap between the second receiving unit and the fourth receiving unit, when viewed in the first direction.

4. The medium supporting unit according to claim 3, wherein the supporting unit defines a fourth gap between the third receiving unit and the fourth receiving unit, when viewed in the first direction.

5. The medium supporting unit according to claim 4, wherein the supporting face has a first corner, a second corner, a third corner, and a fourth corner, the first gap is defined at a position corresponding to the first corner, the second gap is defined at a position corresponding to the second corner, the third gap is defined at a position corresponding to the third corner, and the fourth gap is defined at a position corresponding to the fourth corner.

6. The medium supporting unit according to claim 1, wherein the supporting face is made of a first material, and the receiving face is made of a second material which is different from the first material.

7. The medium supporting unit according to claim 1, wherein unevenness is formed on the receiving face.

8. A recording apparatus comprising:

the medium supporting unit according to claim 1; and a recording unit which can perform recording on a medium which is supported by the medium supporting unit.

* * * * *